US006460652B1

(12) United States Patent
Piipponen

(10) Patent No.: US 6,460,652 B1
(45) Date of Patent: Oct. 8, 2002

(54) BOOM ARRANGEMENT FOR ROCK DRILLING APPARATUS

(75) Inventor: Juha Piipponen, Tampere (FI)

(73) Assignee: Sandvik Tamrock OY, Tampere (FI)

( * ) Notice: Subject to any disclaimer, the term of this patent is extended or adjusted under 35 U.S.C. 154(b) by 0 days.

(21) Appl. No.: 09/701,198

(22) PCT Filed: May 25, 1999

(86) PCT No.: PCT/FI99/00447

§ 371 (c)(1),
(2), (4) Date: Feb. 20, 2001

(87) PCT Pub. No.: WO99/61748

PCT Pub. Date: Dec. 2, 1999

(30) Foreign Application Priority Data

May 26, 1998 (FI) ..... 981166

(51) Int. Cl.[7] ..... E04G 1/00
(52) U.S. Cl. ..... 182/2.9; 182/2.11; 182/141
(58) Field of Search ..... 182/2.1, 2.2, 2.3, 182/2.11, 2.9, 141, 148; 212/238, 266

(56) References Cited

U.S. PATENT DOCUMENTS

| | | | | |
|---|---|---|---|---|
| 2,750,155 A | | 6/1956 | Nixon | |
| 3,637,092 A | * | 1/1972 | George et al. | 214/1 CM |
| 3,744,574 A | * | 7/1973 | Carley | 173/27 |
| 3,777,845 A | * | 12/1973 | Ashworth | 182/17 |
| 3,791,484 A | | 2/1974 | Harrison | |
| 4,175,903 A | * | 11/1979 | Carson | 414/408 |
| 4,484,637 A | * | 11/1984 | Mayer | 173/2 |
| 4,646,875 A | | 3/1987 | Sholl | |
| 5,139,097 A | * | 8/1992 | Rajala | 175/122 |
| 5,427,197 A | * | 6/1995 | Waters | 182/2 |
| 5,507,107 A | * | 4/1996 | Pinomaki | 37/403 |
| 5,669,517 A | * | 9/1997 | Donaldson et al. | 212/196 |
| 5,746,286 A | * | 5/1998 | Mlaker | 182/2.9 |
| 5,944,204 A | * | 8/1999 | Vollmer | 212/261 |

FOREIGN PATENT DOCUMENTS

| | | | |
|---|---|---|---|
| DE | 31 03 694 A1 | | 9/1982 |
| FI | 87184 | | 10/1992 |
| GB | 1 515 114 | | 7/1974 |
| GB | 2 092 097 A | | 8/1982 |
| GB | 2 133 380 A | | 7/1984 |
| JP | 213266 | * | 1/1999 |

* cited by examiner

*Primary Examiner*—Bruce A. Lev
(74) *Attorney, Agent, or Firm*—Burns, Doane, Swecker & Mathis, L.L.P.

(57) ABSTRACT

A boom arrangement for a rock drilling apparatus includes at least one boom and an actuator, e.g., a passenger cage, arranged at a free end of the boom. The boom also includes at least two boom parts articulated pivotably with respect to each other. The first boom part is articulated by a first articulation pivotable substantially in a horizontal direction. The second boom part in turn is arranged at an end of the first boom part, and the second boom part can be turned both vertically and horizontally with respect to the first boom part.

20 Claims, 2 Drawing Sheets

BOOM ARRANGEMENT FOR ROCK DRILLING APPARATUS

BACKGROUND AND SUMMARY

The invention relates to a boom arrangement for a rock drilling apparatus, which arrangement comprises a boom comprising at least two boom parts articulated to each other, at one end of which boom an actuator is arranged, and which boom is equipped with a vertical and a horizontal articulation to turn the actuator to the desired position, and which arrangement comprises a substantially horizontal first boom part whose one end is connected to the rock drilling apparatus pivotably in respect of a vertical axle.

Rock drilling apparatuses employ variously movable passenger lifters comprising a boom and a passenger cage arranged to the free end of the boom in order to take people up. The use of these apparatuses is especially common when digging tunnels. From the passenger cage, rock bolting, measuring and surveying can be performed as well as other such operations in which it may be necessary to get close to the object. Further, maintenance and repair work can conveniently be performed from the passenger cage while the drilling apparatus is in use. The front part of the rock drilling apparatus comprises typically at least one separate working boom, at the free end of which a rock drill and its auxiliary devices or other necessary apparatuses are arranged. A known solution for a boom of a passenger cage is such that rails or corresponding guide surfaces are arranged to both longitudinal sides of the rock drilling apparatus, i.e. in the direction of motion, along which bars or guide surfaces the booms can be moved. Both booms and their passenger cages can be driven separately in the longitudinal direction of the rock drilling apparatus from its back part to the front part and vice versa. This type of structure has, however, the disadvantage that the booms must be driven to pass the control deck at close range, which is a serious risk to the safety of a user of the apparatus. Further, such boom structures limit access to the control deck, from where the apparatus is controlled and managed. Another disadvantage of the solution is that since the guides have to be made firm, they become at the same time heavy and thus they disadvantageously increase the total weight of the rock drilling apparatus. Further, another known boom solution is applicable to passenger cages. In this solution, booms are arranged at the back part of the rock drilling apparatus separately to both sides, which booms can be moved from the back part of the drilling apparatus to the front part and vice versa by means of link mechanisms. The articulation of the booms is arranged in such a manner that different boom parts can be turned in a vertical direction, i.e. they can be lifted and lowered in respect of their fulcrums. In order to produce a sideward movement of the passenger cage, the whole boom structure can be arranged onto a turning base or it is in its entirety arranged to turn in respect of a vertical articulation at the foot of the boom. However, this solution is also disadvantaged by poor safety of drillers working on the control deck, because in this case, too, the boom is arranged to pass the control deck very near. In known solutions, an operator is thus in danger of being pressed between the boom and the frame of the rock drilling apparatus, and said structures make the use of the rock drilling apparatus also otherwise more complicated.

It is an object of this invention to provide a new type of a boom for a rock drilling apparatus, which boom prevents the prior art disadvantages and makes the structure simpler and thus lighter than before.

The boom arrangement of the invention is characterized in that in the rock drilling apparatus, said vertical axle is arranged behind a control deck of drillers, i.e. a drilling worktop, other boom parts are correspondingly arranged at the free end of the first boom part pivotably in respect of the vertical axle, transferring the boom arrangement from the transport position into the working position and vice versa is arranged by turning the first boom part in respect of said vertical axle, other boom parts connected to the first boom part are arranged to move on the side of the rock drilling apparatus, within a distance from the control deck and in the transport position, the actuator can be driven near to the control deck.

The essential idea of the invention is that the rock drilling apparatus comprises at least one variously movable boom, which for its part comprises at least two boom parts articulated pivotably to each other, and an actuator, preferably a passenger cage, is arranged to the free end of the outermost boom part. According to the inventive idea, the boom comprises the substantially horizontally arranged first boom part located nearest to the rock drilling apparatus and arranged to the rock drilling apparatus pivotably in respect of the vertical axle of the rock drilling apparatus by means of the first articulation. Further, the second articulation is arranged between the first boom part and the second boom part, which articulation enables at least the horizontal turning of the second boom part in respect of the first boom part. Thus, the boom can be moved from the transport position into the working position horizontally in respect of the vertical axle of the articulation between the rock drilling apparatus and the boom. The articulation connecting the boom to the rock drilling apparatus is located behind the control deck of drillers, or a so-called drilling worktop, and the movable parts of the boom are arranged to move on the side of the rock drilling apparatus, within a distance from the control deck in a sideward direction, when the boom is transferred between the transport position and the working position. In an embodiment of the invention, the second articulation enables the turning of the second boom part only substantially in a horizontal direction. Such a solution still comprises at least the third boom part, which is in turn at least vertically articulated pivotably in respect of the second boom part. Further, an essential idea of another embodiment of the invention is that the second boom part is articulated to the first boom part by means of the second articulation, which enables both horizontal and vertical turning of the second boom part in respect of the first boom part. Further, an essential idea of the third embodiment of the invention is that the embodiment comprises one boom whose first part is arranged to turn substantially in a horizontal direction in respect of the first articulation in such a manner that the boom can be turned from the first side of the rock drilling apparatus to the other side, whereby separate booms and their actuators need not be arranged to the longitudinal sides of the apparatus.

The invention provides the advantage that the safety of the users of the drilling apparatus is substantially improved, as the booms are no longer passed near the control deck. The moving mechanisms of the booms are no longer in users' immediate proximity, but the articulation connecting the boom to the rock drilling apparatus is located behind the control deck of drillers, i.e. the so-called drilling worktop, and the moving parts of the boom are within a distance sideward from the control deck. Another advantage is also that because of the boom structure of the invention, the rock drilling apparatus can be constructed in such a manner that the transport position is lower and sideward narrower than before, whereby its managing is easier in narrow mine galleries and the like. Thus, the rock drilling apparatus can be transferred as such to its operating place without having to dismantle boom structures because of transports and transfers. Further, the solution of the invention provides a better stability, because compared with known solutions, the fulcrum point of the boom structures is located more in the middle of the rock drilling apparatus. Moreover, the distribution of weight between the front and the rear axles of the rock drilling apparatus is more even. On account of these factors, it is easy to drive and use the apparatus. The use is further facilitated by the fact that the passenger cage is simple and safe to turn in such a manner that it is possible to move from the control deck directly to the cage. One advantage is also that the boom of the invention along with its auxiliary devices are on the whole lighter than known solutions. An embodiment of the invention provides also the advantage that by arranging such a boom solution to the rock drilling apparatus that can be turned to its both sides, two separate booms and their actuators are no longer needed. Such a solution is preferable in regard to the space taken by the rock drilling apparatus and the weight of the apparatus. Also the structure is thus simpler, and there are less parts that need to be serviced and less potential defects. Further, the boom can be arranged in such a manner that it reaches sufficiently far sideward and backward from the rock drilling apparatus.

It is to be noted that in this application a vertical articulation refers to a part which has a vertical axle, whereby it enables the horizontal moving between the parts connected by means of such an articulation. Correspondingly, the pivoted axle of a horizontal articulation is horizontal, whereby the articulation enables the vertical turning of the parts in respect of each other.

The invention will be described in greater detail in the attached drawings, in which

DETAILED DESCRIPTION

Figure 1A:
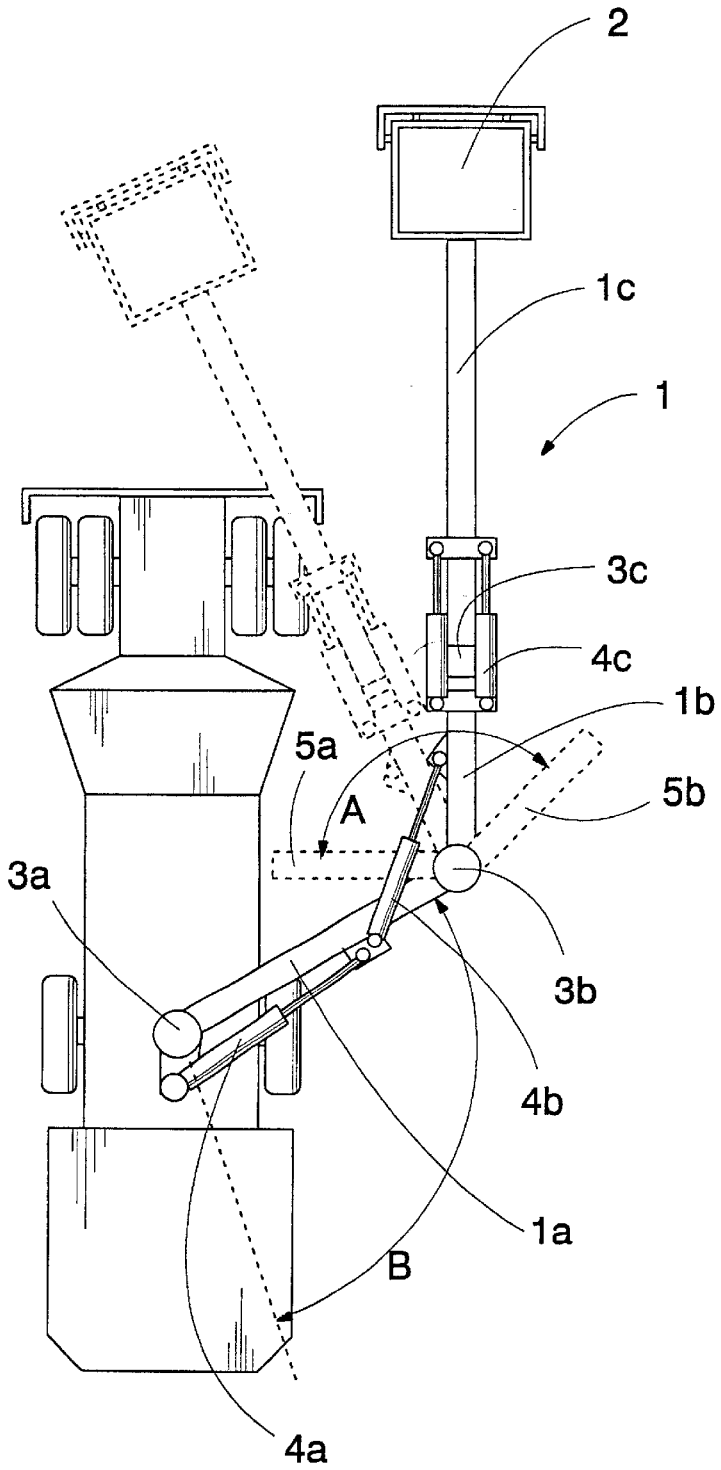
FIGS. 1*a* and 1*b* show schematic top views of a boom solution for a rock drilling apparatus in different positions according to the invention.
Figure 1B:
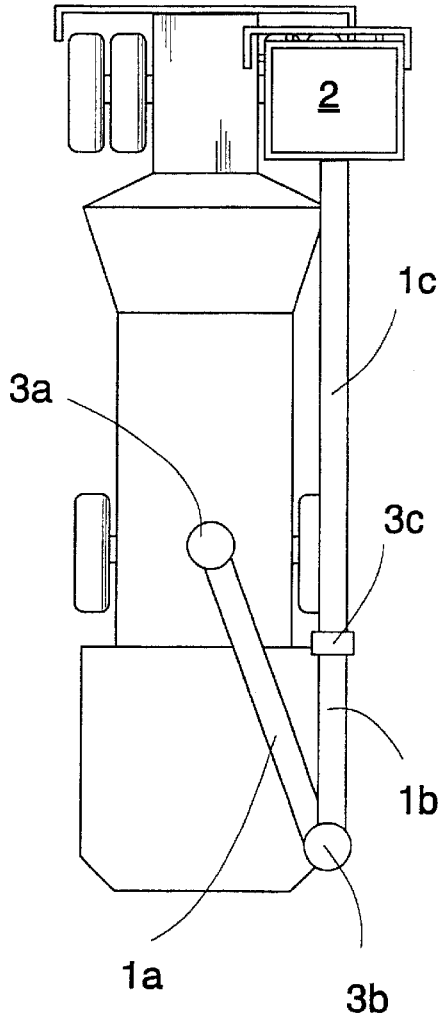

FIGS. 1*a* and 1*b* show highly simplified top views of a rock drilling apparatus, to which a boom 1 of to the invention is arranged, and an actuator 2, in this case a passenger cage, is arranged to the free end of the boom. The actuator may as well be e.g. a rock drill, a bolting device or some other device used in drilling operations, which actuator is preferably arranged to the end of the boom. For the sake of clarity, the figures do not show working booms located normally in the front part of the rock drilling apparatus, to which booms the actual rock drills and other equipment needed for the operation itself are usually arranged. In FIG. 1*a,* the boom is exemplified in two different operational positions, and in the arrangement of FIG. 1*b,* the boom is put to its transport position. It is to be noted that although the figures show only one boom for the sake of clarity, it is perfectly possible to arrange another similar boom and a passenger cage to the other longitudinal side of the rock drilling apparatus to pivot around the same articulation or around two separate articulations. As shown in the figures, the boom 1 comprises now three boom parts 1*a* to 1*c*. The first boom part 1*a* located nearest to the rock drilling apparatus is arranged substantially in a horizontal direction and it is articulated to turn substantially horizontally in respect of the first articulation 3*a*. Seen from the drilling end of the rock drilling apparatus, the first articulation 3*a* of the boom is preferably arranged at the rear axles substantially to the centre-line of the apparatus, in such a manner that the loads of the booms are distributed between the front and rear axles as evenly as possible. Further, as the first articulation is substantially in the centre-line, the loads of the vehicle are also crosswise evenly distributed. Moreover, as the first articulation is located at the rear axle or in its immediate proximity, the frame need not be constructed steadier and heavier than usually on account of the loads caused by the boom. The first turning device 4*a* is arranged in connection with the first articulation 3*a,* which turning device is preferably a pressure medium cylinder or several cylinders but, if required, it can also be e.g. a turning motor run by hydraulic fluid or electricity or any other suitable device, which is arranged to transmit the motion generated by the turning device to move the first boom part by means of suitable turning elements, e.g. levers, swinging circles and other elements. By means of the second articulation 3*b,* the second boom part 1*b* is connected to the extension of the first boom part 1*a*. Like the articulation 3*a,* the second articulation 3*b* is also vertical, and so it enables the substantially horizontal turning of the second boom part 1*b* in respect of the first boom part 1*a*. The second turning device 4*b* is arranged to turn the second boom part 1*b*. Like the first turning device, the second turning device can be a pressure medium cylinder or a motor or some other suitable actuator which is arranged to move the second boom part 1*b* by means of suitable turning elements. Further, the boom 1 comprises the third boom part 1*c,* to the free end of which an actuator 2 is arranged. By means of the third turning device 4*c,* the third boom part can be lifted and lowered in respect of the horizontal third articulation 3*c* arranged to the outermost end of the second boom part, in such a manner that the actuator 2 can be moved up and down. Between the third boom part and the actuator there may also be means for moving the actuator in respect of the outermost end of the third boom part, whereby it is possible e.g. to bend or turn the actuator a bit without necessarily having to move the boom itself at all. FIG. 1*a* shows also examples of some extreme turning positions of the second boom part by broken lines 5*a* and 5*b*. The position 5*a* corresponds to the transport position shown in FIG. 1*b* and the position 5*b* for its part to the potential extreme turning position in the opposite direction. Reference A in the figure denotes an exemplificational turning angle around the second articulation 3*b*. Further, reference B denotes a turning angle in respect of the first articulation 3*a*. It is naturally to be understood that the lengths and measures of the different boom parts as well as the turning angles of the articulations may vary. The dimensions of the boom are at least affected by the desired reach and the size and measures of the rock drilling apparatus. The boom may also comprise means, by which the second and the third boom part are, if required, made to turn parallel to the rock drilling apparatus from the transport position into the working position. Such means can be located in connection with turning devices and they can operate mechanically or hydraulically. Because of the parallel turning movement, the risk of the boom colliding with other booms and structures of the rock drilling apparatus, e.g. a control cabin, can be reduced.

Further, it is possible to arrange the second articulation 3*b* in such a manner that the second boom part 1*b* can be turned both horizontally and vertically in respect of the fulcrum in question and the first boom part 1*a*. Thus, it is possible to arrange the boom in such a manner it only comprises two parts, the first of which is arranged to turn substantially horizontally in respect of the vertical axle of the first fulcrum and the second boom part, to the free end of which a passenger cage is in this case arranged, and which is, as mentioned earlier, arranged to turn both horizontally and vertically in respect of the second fulcrum.

Further, if only one boom is used on one side of the rock drilling apparatus, the first articulation can be arranged asymmetrically in respect of the centre-line closer to that side of the rock drilling apparatus where there is no boom. By positioning the articulation like this, the rock drilling apparatus can be made crosswise stable, regardless of the use of the boom.

When using several booms and passenger cages, sensors can be arranged in contact with the booms, which sensors recognise the positions of the boom in such a way that collisions between the booms and between the booms and other structures of the rock drilling apparatus can be prevented. The risk of collision can also be reduced by arranging the first articulation to bend suitably backwards, whereby the boom takes a lower position when put to the transport position and correspondingly, when it is turned forwards in respect of the articulation bent backwards, the free end of the boom automatically rises as a result of this turning movement. For the sake of clarity, FIGS. 1*b* and 2 do not show the turning device or turning elements of the boom.

Figure 2:
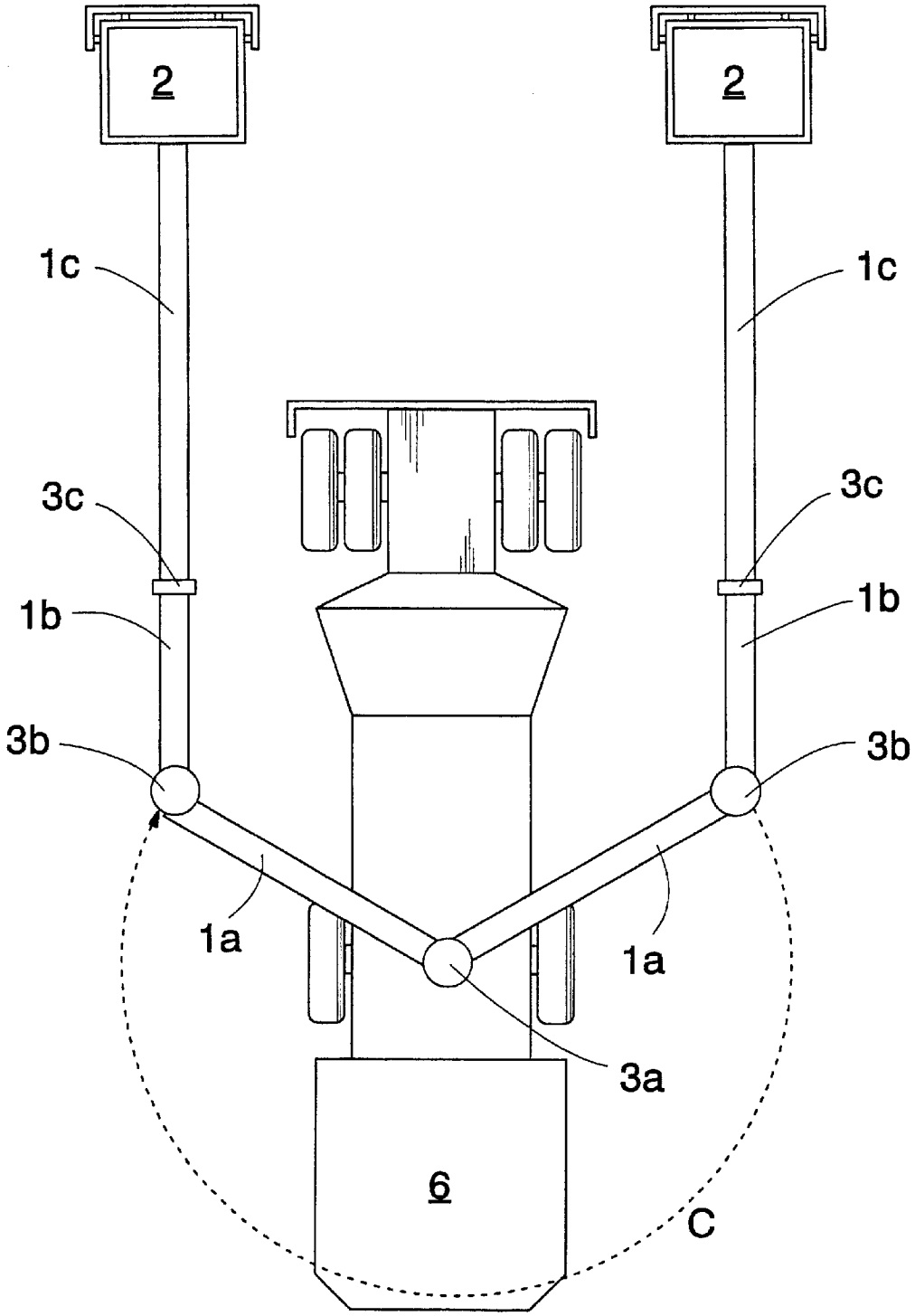
FIG. 2 shows a schematic top view of another boom solution for a rock drilling apparatus according to the invention.

FIG. 2 shows a highly simplified top view of another possible solution. Only one boom is used therein, the boom being turnable to both sides of the rock drilling apparatus. In this case, one boom reaches at least equally far as two booms, but it does not take up so much space or weigh so much. In said solution, the first boom part 1*a* arranged to turn horizontally can be pivoted around the back part of the rock drilling apparatus from the one side of the rock drilling apparatus to the other side. This requires naturally that those parts of the rock drilling apparatus which are behind the first fulcrum 3*a* are located under the horizontally turning boom part in such a way that the boom has enough space to pivot over them. The first fulcrum is therefore arranged higher than the back part of the rock drilling apparatus. This is usually accomplished fairly easily, because an easily low-constructible power unit 6 along with its motors and auxiliary devices are generally arranged to the very back part of the rock drilling apparatus. If necessary, it is possible to arrange means for raising the first articulation at least for the time that the boom is moved from the one side of the rock drilling apparatus to the other side. This can be accomplished e.g. in such a manner that the first articulation is hydraulically arranged to a support which can be moved up and down, or directly in contact with a hydraulic cylinder. Moving the boom from the one side of the rock drilling apparatus to the other side naturally requires also that the second boom part and other boom parts are capable of moving over the rock drilling apparatus. Other boom parts 1*b* and 1*c* can be raised up during transfer. Such a structure further requires that turning devices and turning elements not described herein have been arranged in such a manner that this type of boom use has been taken into account. In some cases, it is also possible to arrange a horizontal articulation in contact with the first articulation in such a manner that the first boom part can be bent diagonally upwards at least for the time that the boom is made to turn from the one to the other side of the rock drilling apparatus. Moreover, it is possible to arrange the boom in such a manner that it can be directed backward from the rock drilling apparatus. Thus, it is not dangerous to operate it behind the apparatus while other tasks are carried out at the front part by means of the working booms.

The drawings and the description related to them are only intended to illustrate the idea of the invention. In its details, the invention may vary within the scope of the claims. Thus, the boom can comprise more boom parts than mentioned in the figures and the description. The extension of the horizontally turning part can have several vertically and/or horizontally turnable boom parts, whereby the boom can be turned in even more various ways. Thus, it is possible to provide a rock drilling apparatus with a boom, at the end of which there is a passenger cage which enables easy access.

What is claimed is:

1. A rock drilling apparatus having a boom arrangement comprising:

a rock drilling apparatus having a control deck and a vertical axle disposed behind the control deck;

a boom comprising at least two boom parts articulated to each other;

an actuator arranged at an end of the boom;

the boom including a first, vertical articulation and a horizontal articulation adapted to move the actuator to desired positions, the boom including a substantially horizontal first boom part having a first end adapted to be pivotably connected to the vertical axle at the first articulation, and at least one other boom part pivotably arranged at a second, free end of the first boom part, and wherein the boom is movable between a transport position and a working position by turning the first boom part about the vertical axle, and wherein the at least one other boom part is movable in a longitudinal direction of the rock drilling apparatus proximate at least one longitudinal side of the rock drilling apparatus and disposed at a distance from the control deck and, when the boom is moved to the transport position, the actuator is proximate the control deck, wherein the rock drilling apparatus has a front end and a rear end, the vertical axle is disposed between the control deck and the rear end, and the actuator is disposed proximate the front end when the boom is in the working position.

2. A rock drilling apparatus as claimed in claim 1, wherein the actuator is a passenger cage.

3. A rock drilling apparatus as claimed in claim 2, wherein the at least one other boom part includes a second, substantially horizontal boom part connected to the first boom part by a second articulation having a second vertical axle, and the second boom part is movable substantially horizontally about the second vertical axle.

4. A rock drilling apparatus as claimed in claim 2, wherein the at least one other boom part includes a second boom part connected relative to the first boom part by a second articulation permitting at least one of vertical and horizontal movement of the second boom part.

5. A rock drilling apparatus as claimed in claim 2, wherein the boom is turnable about the first articulation from a first side of the rock drilling apparatus to a second, opposite side of the rock drilling apparatus.

6. A rock drilling apparatus as claimed in claim 2, further comprising a second boom and a second actuator at an end of the second boom.

7. A rock drilling apparatus as claimed in claim 1, wherein the at least one other boom part includes a second, substantially horizontal boom part connected to the first boom part by a second articulation having a second vertical axle, and the second boom part is movable substantially horizontally about the second vertical axle.

8. A rock drilling apparatus as claimed in claim 1, wherein the at least one other boom part includes a second boom part connected relative to the first boom part by a second articulation permitting at least one of vertical and horizontal movement of the second boom part.

9. A rock drilling apparatus as claimed in claim 1, wherein the boom is turnable about the first articulation from a first side of the rock drilling apparatus to a second, opposite side of the rock drilling apparatus.

10. A rock drilling apparatus as claimed in claim 1, further comprising a second boom and a second actuator at an end of the second boom.

11. A rock drilling apparatus as claimed in claim 10, wherein the boom and the second boom each turn about the first articulation.

12. A rock drilling apparatus as claimed in claim 10, wherein the second boom includes a substantially horizontal first boom part having a first end adapted to be pivotably connected to a second vertical axle of the drilling apparatus at a further articulation.

13. A boom arrangement for a rock drilling apparatus having a control deck and a vertical axle disposed behind the control deck, comprising:

a boom comprising at least two boom parts articulated to each other;

an actuator arranged at an end of the boom;

the boom including a first, vertical articulation and a horizontal articulation adapted to move the actuator to desired positions, the boom including a substantially horizontal first boom part having a first end adapted to be pivotably connected to the vertical axle at the first articulation, and at least one other boom part pivotably arranged at a second, free end of the first boom part, and wherein the boom is movable between a transport position and a working position by turning the first boom part about the vertical axle, and wherein the at least one other boom part is adapted to be moved in a longitudinal direction of the rock drilling apparatus proximate at least one longitudinal side of the rock drilling apparatus and disposed at a distance from the control deck and, when the boom is moved to the transport position, the actuator is proximate the control deck, wherein the rock drilling apparatus has a front end and a rear end, and the vertical axle is disposed between the control deck and the rear end, and the actuator is disposed proximate the front end when the boom is in the working position.

14. A boom arrangement for a rock drilling apparatus as claimed in claim 13, wherein the actuator is a passenger cage.

15. A boom arrangement for a rock drilling apparatus as claimed in claim 13, wherein the at least one other boom part includes a second, substantially horizontal boom part connected to the first boom part by a second articulation having a second vertical axle, and the second boom part is movable substantially horizontally about the second vertical axle.

16. A boom arrangement for a rock drilling apparatus as claimed in claim 13, wherein the at least one other boom part includes a second boom part connected relative to the first boom part by a second articulation permitting at least one of vertical and horizontal movement of the second boom part.

17. A boom arrangement for a rock drilling apparatus as claimed in claim 13, wherein the boom is turnable about the first articulation from a first side of the rock drilling apparatus to a second, opposite side of the rock drilling apparatus.

18. A boom arrangement for a rock drilling apparatus as claimed in claim 13, further comprising a second boom and a second actuator at an end of the second boom.

19. A boom arrangement for a rock drilling apparatus as claimed in claim 18, wherein the boom and the second boom each turn about the first articulation.

20. A boom arrangement for a rock drilling apparatus as claimed in claim 18, wherein the second boom includes a substantially horizontal first boom part having a first end adapted to be pivotably connected to a second vertical axle of the drilling apparatus and define therewith a further articulation.

* * * * *